US007766603B2

(12) United States Patent
Beckford et al.

(10) Patent No.: US 7,766,603 B2
(45) Date of Patent: Aug. 3, 2010

(54) ROTOR BLADE CONTAINMENT ASSEMBLY FOR A GAS TURBINE ENGINE

(75) Inventors: Peter R Beckford, Derby (GB); Stephen J Booth, Derby (GB)

(73) Assignee: Rolls-Royce plc, London (GB)

( * ) Notice: Subject to any disclaimer, the term of this patent is extended or adjusted under 35 U.S.C. 154(b) by 399 days.

(21) Appl. No.: 11/415,299

(22) Filed: May 2, 2006

(65) Prior Publication Data

US 2006/0269402 A1 Nov. 30, 2006

(30) Foreign Application Priority Data

May 24, 2005 (GB) ..... 0510538.2

(51) Int. Cl.
*F01D 21/00* (2006.01)
*F01B 25/16* (2006.01)

(52) U.S. Cl. ..... 415/9; 415/119

(58) Field of Classification Search ..... 415/9, 415/119

See application file for complete search history.

(56) References Cited

U.S. PATENT DOCUMENTS 4,377,370 A * 3/1983 Porcelli ..... 415/9
4,411,589 A 10/1983 Joubert
5,160,248 A * 11/1992 Clarke ..... 415/9
5,513,949 A * 5/1996 Armstrong ..... 415/9
6,769,864 B2 * 8/2004 Sathianathan et al. ..... 415/9
6,913,436 B2 * 7/2005 McMillan et al. ..... 415/9
2005/0201860 A1 * 9/2005 Care ..... 415/173.3

FOREIGN PATENT DOCUMENTS

EP 1 245 791 A 10/2004
GB 2 281 941 A 3/1995
GB 2 362 432 A 11/2001
SU 1 553 737 AB 6/1988

* cited by examiner

*Primary Examiner*—Edward Look
*Assistant Examiner*—Dwayne J White
(74) *Attorney, Agent, or Firm*—Jeffrey S. Melcher; Manelli Denison & Selter PLLC

(57) ABSTRACT

A fan blade containment assembly (38) for a turbofan gas turbine engine (10) comprises a cylindrical, or frustoconical, casing (40) arranged to surround an arrangement of fan blades (26). At least one hollow tubular member (66) is arranged radially within and secured to the casing (40) and the at least one hollow tubular member (66) contains a filler material (68). The at least one hollow tubular member (66) extends circumferentially. The hollow tubular member (66) is helical and the axial spacing between the adjacent turns of the tubular member (66) varies and the density of the filler material (68) varies in order to match the severity of the impact expected at each axial location along the casing 40 of the fan blade containment assembly (38).

19 Claims, 2 Drawing Sheets

ROTOR BLADE CONTAINMENT ASSEMBLY FOR A GAS TURBINE ENGINE

FIELD OF THE INVENTION

The present invention relates to a rotor blade containment assembly for a gas turbine engine and in particular for a fan rotor blade containment assembly for a turbofan gas turbine engine.

BACKGROUND OF THE INVENTION

Turbofan gas turbine engines for powering aircraft conventionally comprise a core engine, which drives a fan. The fan comprises a number of radially extending fan blades mounted on a fan rotor which is enclosed by a generally cylindrical, or frustoconical, fan casing. The core engine comprises one or more turbines, each one of which comprises a number of radially extending turbine blades enclosed by a cylindrical, or frustoconical, turbine casing.

There is a remote possibility with such engines that part, or all, of a fan blade, or a turbine blade, could become detached from the remainder of the fan or turbine. In the case of a fan blade becoming detached this may occur as the result of, for example, the turbofan gas turbine engine ingesting a bird or other foreign object.

The use of containment rings for turbofan gas turbine engine casings is well known.

In the event that a blade becomes detached, the casing is subjected to two significant impacts. The first impact occurs generally in the plane of the rotor blade assembly as a result of the release of the radially outer portion of the rotor blade. The second impact occurs downstream of the plane of the rotor blade assembly as a result of the radially inner portion of the rotor blade being projected in a downstream direction by the following rotor blade.

Our published European patent application EP1245791A2, published 2 Oct. 2002, describes a fan blade containment assembly to reduce damage and/or penetration of the fan casing downstream of the plane of rotor blade assembly.

Our published UK patent application GB2281941A, published 22 Mar. 1995, describes a fan blade containment assembly comprising three layers. The first layer comprises a fan casing adjacent the fan blades, the second layer comprises a plurality of deformable tubes arranged with their axes arranged parallel to the axis of the gas turbine engine and around the fan casing and the third layer comprises a strong woven fibrous material around the deformable tubes.

SUMMARY OF THE INVENTION

Accordingly the present invention seeks to provide a novel rotor blade containment casing for a gas turbine engine.

Accordingly the present invention provides a rotor blade containment assembly for a gas turbine engine comprising a cylindrical, or frustoconical, casing arranged to surround an arrangement of rotor blades, at least one hollow tubular member arranged radially within and secured to the casing, the at least one hollow tubular member containing a filler material.

Preferably the at least one hollow tubular member extends circumferentially within the casing.

Preferably the at least one hollow tubular member is arranged in a helix within the casing.

There may be a plurality of hollow tubular members arranged in a helix within the casing.

The plurality of hollow tubular members may be such that the turns of a first hollow tubular member are arranged between adjacent turns of a second hollow tubular member. The plurality of hollow tubular members may be arranged to be axially adjacent each other.

The at least one hollow tubular member may be arranged such that some of the adjacent turns of the at least one hollow tubular member are in abutting contact. The at least one hollow tubular member may be arranged such that some of the adjacent turns of the at least one tubular member are spaced apart axially. The at least one hollow tubular member may be arranged such that the axial spaces between adjacent turns of the at least one hollow tubular member vary along the casing.

Alternatively, there is a plurality of hollow tubular members and each hollow tubular member is formed into a ring. The hollow tubular members may be coaxial.

The hollow tubular members may be arranged such that some of the adjacent hollow tubular members are in abutting contact. The hollow tubular members may be arranged such that some of the adjacent tubular members are spaced apart axially. The hollow tubular members may be arranged such that the axial spaces between the hollow tubular members vary axially along the casing.

Preferably the at least one hollow tubular member contains a foam, preferably a metal foam.

The density of the filler in the at least one hollow tubular member may be constant throughout the length of the at least one hollow tubular member. Alternatively the density of the filler in the at least one hollow tubular member may be vary throughout the length of the at least one hollow tubular member.

The density of the filler in adjacent hollow tubular members may be constant throughout the length of the casing. Alternatively the density of the filler in adjacent hollow tubular members may vary throughout the length of the casing.

The at least one hollow tubular member may be bonded to the casing.

The at least one hollow tubular member may be circular in cross-section or rectangular in cross-section.

An acoustic liner may be arranged radially within the at least one hollow tubular member. The acoustic liner may comprise at least one panel. Each panel may comprise a perforate member, an imperforate backing member and a cellular structure arranged between the perforate member and the imperforate backing member.

Alternatively, the at least one hollow tubular member may be perforate, such that the at least once hollow tubular member defines an acoustic liner.

The rotor blades may be fan blades and the casing is a fan casing.

BRIEF DESCRIPTION OF THE DRAWINGS

The present invention will be more fully described by way of example with reference to the accompanying drawings in which.

DETAILED DESCRIPTION OF THE INVENTION

Figure 1:
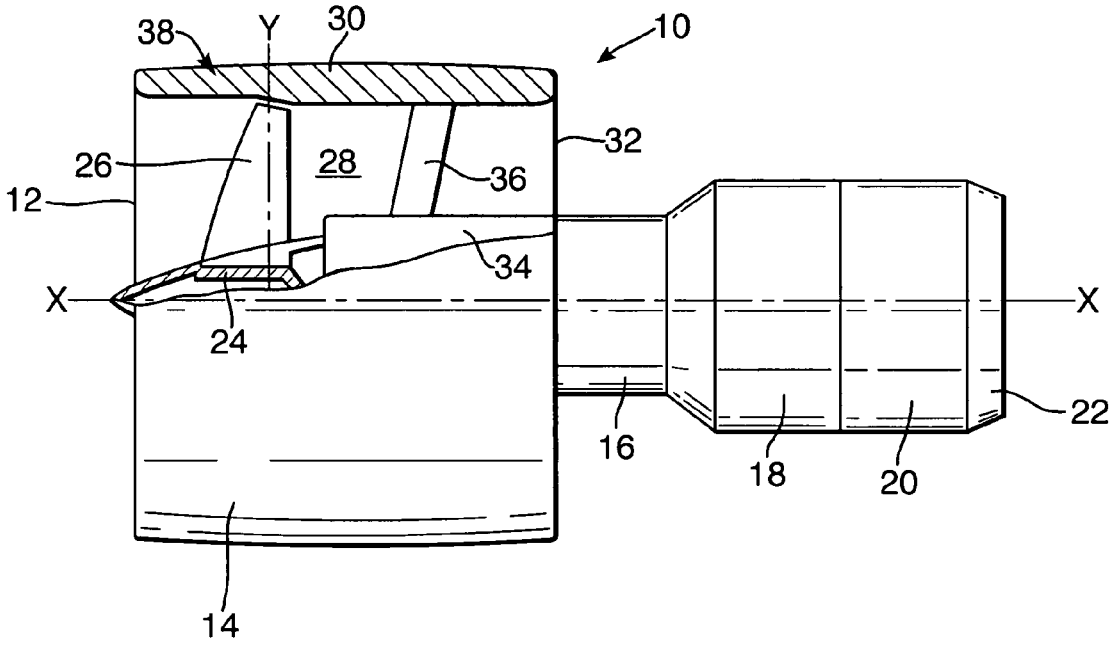
FIG. 1 is a partially cut away view of a turbofan gas turbine engine having a fan blade containment assembly according to the present invention.

A turbofan gas turbine engine 10, as shown in FIG. 1, comprises in flow series an intake 12, a fan section 14, a compressor section 16, a combustion section 18, a turbine section 20 and an exhaust 22. The turbine section 20 comprises one or more turbines arranged to drive one or more compressors in the compression section 16 via shafts (not shown). The turbine section 20 also comprises a turbine to drive the fan section 14 via a shaft (not shown). The fan section 14 comprises a fan rotor 24, which carries a plurality of circumferentially spaced radially extending fan blades 26. The fan rotor 24 and fan blades 26 rotate about the axis X of the turbofan gas turbine engine 10, substantially in a plane perpendicular Y to the axis X. The fan section 12 also comprises a fan duct 28 defined partially by a fan casing 30. The fan duct 28 has an outlet 32 at its axially downstream end. The fan casing 30 is secured to a core engine casing 34 by a plurality of circumferentially spaced radially extending fan outlet guide vanes 36. The fan casing 30 surrounds the fan rotor 24 and fan blades 26. The fan casing 30 also comprises a fan blade containment assembly 38.

Figure 2A:
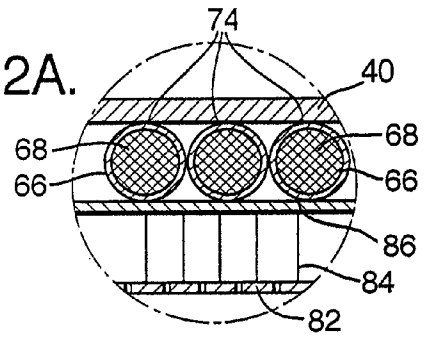
FIG. 2A is a further enlargement of a portion of the fan blade containment assembly shown in FIG. 2.
Figure 2B:
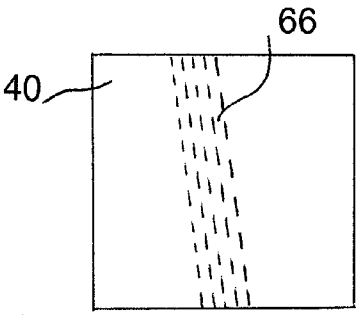
FIG. 2B is a to view of the metal casing 40 and tubular members 66 of the fan blade containment assembly shown in FIG. 2.
Figure 2:
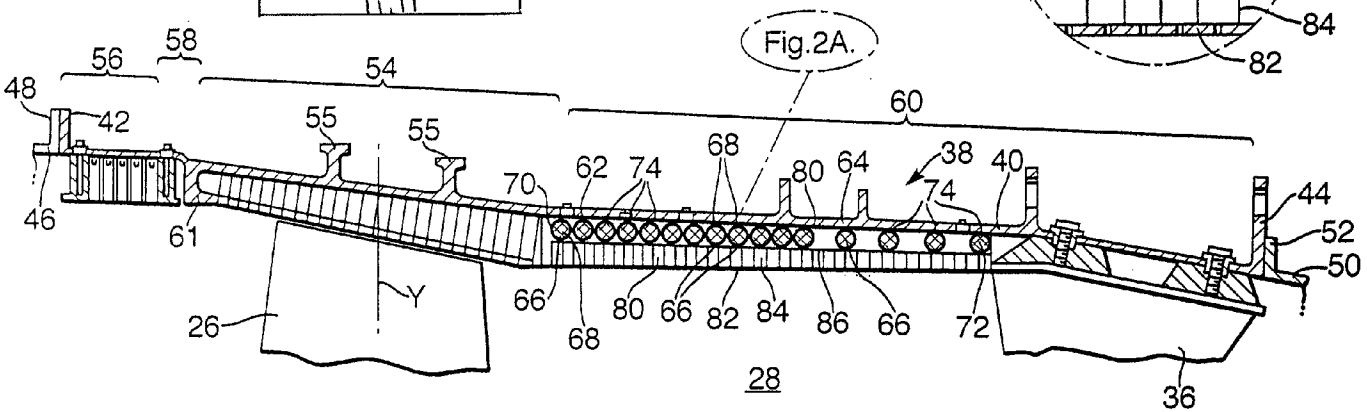
FIG. 2 shows an enlarged cross-sectional view of the fan blade containment assembly shown in FIG. 1.

The fan casing 30 and fan blade containment assembly 38 is shown more clearly in FIGS. 2 and 2A. The fan blade containment assembly 38 comprises a metal cylindrical, or frustoconical, casing 40. The metal casing 40 comprises an upstream flange 42 by which the fan blade containment assembly 38 is connected to a flange 48 on an intake assembly 46 of the fan casing 30. The metal casing 40 also comprises a downstream flange 44 by which the fan blade containment assembly 38 is connected to a flange 52 on a rear portion 50 of the fan casing 30.

The metal casing 40 provides the basic fan blade containment and provides a connection between the intake casing 46 and the rear portion 50 of the fan casing 30.

The metal casing 40 comprises an upstream portion 56, a transition portion 58, a main blade containment portion 54 and a downstream portion 60. The upstream portion 56 comprises the flange 42 and the downstream portion 60 comprises the flange 44.

The upstream portion 56 is upstream of the plane Y of the fan blades 26 and provides debris protection for the fan blade containment assembly 38. The main blade containment portion 54 is substantially in the plane Y containing the fan blades 26 and comprises a radially inwardly and axially downstream extending flange, or hook, 61 at its upstream end. The main blade containment portion 54 also comprises one, or more, integral T-section ribs 55, which extend radially outwardly from the main blade containment portion 54. The T-section ribs 55 extend circumferentially around the main blade containment portion 54 to stiffen the metal casing 40 to improve the fan blade 26 containment properties. The transition portion 58 connects the main blade containment portion 54 and the upstream portion 56 to transmit loads from the main blade containment portion 54 to the upstream flange 42 on the upstream portion 56. The downstream portion 60 is downstream of the plane Y of the fan blades 26, and provides protection for where a root of a fan blade 26 impacts the fan blade containment assembly 38.

The downstream portion 60 comprises an impact protection means 64 arranged coaxially within and abutting the radially inner surface 62 of the downstream portion 60. The impact protection means 64 is located in the region of the downstream portion 60 between the main blade containment portion 54 and the fan outlet guide vanes 36.

The impact protection means 64 comprises a tubular member 66, which is wound in a helical manner within the downstream portion 60 of the metal casing 40 of the fan blade containment assembly 38, as shown in FIG. 2B. The tubular member 66 is secured to the radially inner surface 62 by epoxy adhesive, bonding, brazing, fusing or other suitable means. The tubular member 66 is hollow and contains a filler material 68. The tubular members may comprise metal, alloy, or other suitable materials, for example polymer, plastic. The filler material may comprise foam, for example metal foam, polymer foam, other suitable foam, low-density granular material filler, elastomer filler or other suitable filler.

The tubular member 66 is preferably the same material as the filler material 68, for example a metal tubular member and a metal foam filler and the tubular member 66 may be a metal skin formed during the production of the metal foam filler.

The density of the filler 68 varies along the tubular member 66 in order to match the severity of the impact expected at each axial location along the downstream portion 60 of the metal casing 40 of the fan blade containment assembly 38. Generally the density of the filler 68 progressively decreases from the upstream end 70 to the downstream end 72 of the tubular member 66, e.g. the density of the filler 68 progressively decreases in an axial downstream direction along the downstream portion 60 of the metal casing 40 of the fan blade containment assembly 38.

The axial spacing between adjacent turns 74 of the tubular member 66 varies along the tubular member 66 also in order to match the severity of the impact expected at each axial location along the downstream portion 60 of the metal casing 40 of the fan blade containment assembly 38. Generally the axial spacing between adjacent turns 74 of the tubular member 66 progressively increases from the upstream end 70 to the downstream end 72 of the tubular member 66 e.g. the axial spacing between adjacent turns 74 of the tubular member 66 progressively increases in an axial downstream direction along the downstream portion 60 of the metal casing 40 of the fan blade containment assembly 38. In particular in this arrangement the adjacent turns 74 of the tubular member 66 abut each other at the upstream end 70 of the tubular member 66.

It is to be noted that the severity of the impact of the root of the fan blade 26 varies over the downstream portion 60 of the metal casing 40 of the fan blade containment assembly 38. In one example the adjacent turns 74 of the tubular member 66 abut each other and the filler material 68 has greatest density at the upstream end 70 of the tubular member 66 and the adjacent turns 74 of the tubular member 66 have greatest axial spacing and the filler material 68 has least density at the downstream end 72 of the tubular member 66. The filler material 68 has greatest density at a location subject to highest impact energy and least density as a location subject to lowest impact energy.

An acoustic liner 80 is provided within the downstream portion 60 of the metal casing 40 of the fan blade containment casing 38 on the inner surface of the impact protection means 64. The acoustic liner 80 comprises a perforate member 82, an imperforate member 86 and a cellular, e.g. honeycomb, structure 84 arranged between the perforate member 82 and the imperforate member 86. The acoustic liner 80 partially defines the outer surface of the fan duct 28. The acoustic liner 80 may comprise a single annular panel, a plurality of circumferentially arranged panels, a plurality of axially arranged annular panels or a plurality of circumferentially and axially arranged panels.

In this arrangement the tubular member is circular in cross-section, but other suitable cross-sections may be used.

In operation of the turbofan gas turbine engine 10, in the event that a fan blade 26, a radially outer portion of a fan blade 26 or a radially inner portion of a fan blade 26 becomes detached it encounters the metal casing 40. The main blade containment portion 54 of the metal casing 40 is impacted by the fan blade 26 or radially outer portion of the fan blade 26 and effectively removes energy from the fan blade 26 or radially outer portion of the fan blade 26. The radially inner portion of the fan blade 26 impacts the downstream portion 60 of the metal casing 40 and the impact protection means 64 provides protection to the downstream portion 60 of the metal casing 40. The radially inner portion of the fan blade 26 passes through the acoustic liner 80, which offers little resistance to the motion of the radially inner portion of the fan blade 26. The tubular member 66 containing the filler material 68 absorbs the energy of the radially inner portion of the fan blade 26 and spreads the impact load over a much greater area of the downstream portion 60 of the metal casing 40. The tubular member 66 acts as a spacer and prevents the radially inner portion of the fan blade 26 from contacting and penetrating the downstream portion 60 of the metal casing 40.

Although this embodiment has described the use of a single tubular member 66 wound in a helix within the downstream portion 60 of the metal casing 40 it may be possible to provide two or more tubular members wound in a helix within the downstream portion 60 of the metal casing 40 with the turns of one tubular member being arranged between the turns of another tubular member.

Although this embodiment has described the use of a tubular member 66 with the density of the filler material 68 and the axial spacing between adjacent turns of the tubular member varying along the length of the tubular member, it may be possible for the density to remain constant and the axial spacing between the adjacent turns of the tubular member to vary. The axial spacing between the adjacent turns of the tubular member may remain constant and the density of the filler material may vary. The axial spacing between the turns of the tubular member may remain constant and the density of the filler may remain constant.

Figure 3:
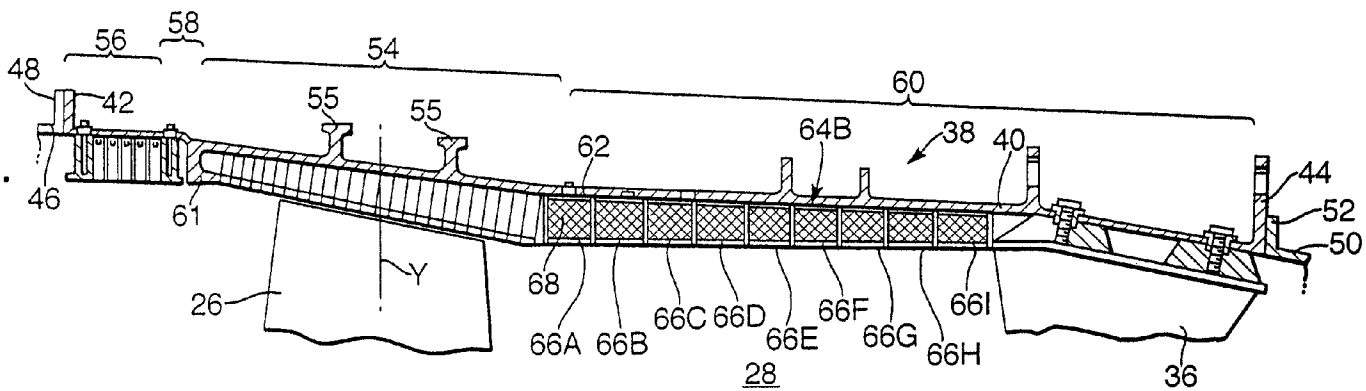
FIG. 3 shows an alternative enlarged cross-sectional view of the fan blade containment assembly shown in FIG. 1.

An alternative fan casing 30 and fan blade containment assembly 38 is shown more clearly in FIG. 3. The arrangement is similar to that shown in FIG. 2 and like parts are denoted by like numerals.

The downstream portion 60 comprises an impact protection means 64B arranged coaxially within and abutting the radially inner surface 62 of the downstream portion 60. The impact protection means 64B is located in the region of the downstream portion 60 between the main blade containment portion 54 and the fan outlet guide vanes 36.

The impact protection means 64B comprises a plurality of tubular members 66A, 66B, 66C, 66D, 66E, 66F, 66G, 66H and 66I which are arranged coaxially within the downstream portion 60 of the metal casing 40 of the fan blade containment assembly 38. The tubular members 66A, 66B, 66C, 66D, 66E, 66F, 66G, 66H and 66I are secured to the radially inner surface 62 by epoxy adhesive, bonding, brazing, fusing or other suitable means. The tubular members 66A, 66B, 66C, 66D, 66E, 66F, 66G, 66H and 66I are hollow and contain filler material 68. The tubular members may comprise metal, alloy, or other suitable materials, for example polymer, plastic. The filler material may comprise foam, for example metal foam, polymer foam, other suitable foam, low-density granular material filler, elastomer filler or other suitable filler.

The density of the filler material 68 in the tubular members 66A, 66B, 66C, 66D, 66E, 66F, 66G, 66H and 66I varies in order to match the severity of the impact expected at each axial location along the downstream portion 60 of the metal casing 40 of the fan blade containment assembly 38. Generally the density of the filler 68 progressively decreases from the tubular member 66A to the tubular member 66I, e.g. the density of the filler 68 in the tubular members 66A, 66B, 66C, 66D, 66E, 66F, 66G, 66H and 66I progressively decreases in an axial downstream direction along the downstream portion 60 of the metal casing 40 of the fan blade containment assembly 38. In this arrangement the tubular members 66A, 66B, 66C, 66D, 66E, 66F, 66G, 66H and 66I are rectangular in cross-section and abut each other so that the radially inner surfaces of the tubular members 66A, 66B, 66C, 66D, 66E, 66F, 66G, 66H and 66I partially define the outer surface of the fan duct 28.

No separate acoustic liner is provided, but instead the radially inner surfaces of the tubular members 66A, 66B, 66C, 66D, 66E, 66F, 66G, 66H and 66I are perforated so that the tubular members 66A, 66B, 66C, 66D, 66E, 66F, 66G, 66H and 66I and their filler material 68 define an acoustic liner.

Alternatively, the radially inner surfaces of the tubular members 66A, 66B, 66C, 66D, 66E, 66F, 66G, 66H and 66I are machined away to uncover the filler material 68 so that the radially inner surfaces of the filler material 68 within the tubular members 66A, 66B, 66C, 66D, 66E, 66F, 66G, 66H and 66I partially define the outer surface of the fan duct 28 and define an acoustic liner. The coaxial tubular members do not have any axially extending joints and do not give rise to any unwanted noise. It is easy, quick and relatively cheap to remove damaged tubular members individually.

In operation the impact protection means 64B works substantially the same as the impact protections means 64.

The advantages of the present invention are that the fan blade containment assembly is simplified reducing the time and cost to manufacture and/or repair the fan blade containment assembly. The tubular members and their filler material have high energy absorption capacity and load spreading ability to protect the downstream portion of the metal casing of the fan blade containment assembly.

The tubular members and filler material may be used to replace conventional ice impact panels in the fan blade containment assembly, by selecting an appropriate thickness for the tubular member and an appropriate density for the filler material.

It may be possible to use a plurality of coaxial annular tubular members containing filler material as described in the embodiment in FIG. 3 in the embodiment of FIG. 2 rather than a helical tubular member and to provide varying axial spacing between the annular tubular members.

The metal casing may be manufactured from any suitable metal or metal alloy. Preferably the metal casing comprises a steel alloy, aluminium, an aluminium alloy, magnesium, a magnesium alloy, titanium, a titanium alloy, nickel or a nickel alloy.

Although the present invention has been described with reference to a metal casing it may be possible to use the invention on other types of casings.

We claim:

1. A rotor blade containment assembly for a gas turbine engine comprising:

a cylindrical, or frustoconical, casing having a radially inner surface and being arranged to surround an arrangement of rotor blades;

the casing comprising a containment portion surrounding the rotor blades and a downstream portion that is downstream of the rotor blades;

at least one hollow tubular member arranged radially within and secured to the radially inner surface of the downstream portion of the casing, the at least one hollow tubular member containing a filler material, and the at least one hollow tubular member extends in a helix circumferentially within the radially inner surface of the casing.

2. A rotor blade containment assembly as claimed in claim 1 wherein there is a plurality of hollow tubular members arranged in a helix within the casing.

3. A rotor blade containment assembly as claimed in claim 2 wherein the plurality of hollow tubular members are arranged such that the turns of a first hollow tubular member are arranged between adjacent turns of a second hollow tubular member.

4. A rotor blade containment assembly as claimed in claim 3 wherein the at least one hollow tubular member is arranged such that some of the adjacent turns of the at least one hollow tubular member are in abutting contact.

5. A rotor blade containment assembly as claimed in claim 3 wherein the at least one hollow tubular member is arranged such that some of the adjacent turns of the at least one tubular member are spaced apart axially.

6. A rotor blade containment assembly as claimed in claim 5 wherein the at least one hollow tubular member is arranged such that the axial spaces between adjacent turns of the at least one hollow tubular member vary along the casing.

7. A rotor blade containment assembly as claimed in claim 2 wherein the plurality of hollow tubular members are arranged to be axially adjacent each other.

8. A rotor blade containment assembly as claimed in claim 1 wherein the hollow tubular members are arranged such that some of the adjacent hollow tubular members are in abutting contact.

9. A rotor blade containment assembly as claimed in claim 1 wherein the at least one hollow tubular member contains a foam.

10. A rotor blade containment assembly as claimed in claim 1 wherein the density of the filler in the at least one hollow tubular member is constant throughout the length of the at least one hollow tubular member.

11. A rotor blade containment assembly as claimed in claim 1 wherein the density of the filler in the at least one hollow tubular member varies throughout the length of the at least one hollow tubular member.

12. A rotor blade containment assembly as claimed in claim 1 wherein the at least one hollow tubular member is bonded to the casing.

13. A rotor blade containment assembly as claimed in claim 1 wherein the at least one hollow tubular member is circular in cross-section or rectangular in cross-section.

14. A rotor blade containment assembly as claimed in claim 1 wherein an acoustic liner is arranged radially within the at least one hollow tubular member.

15. A rotor blade containment assembly as claimed in claim 14 wherein the acoustic liner comprises at least one panel.

16. A rotor blade containment assembly as claimed in claim 15 wherein each panel comprises a perforate member, an imperforate backing member and a cellular structure arranged between the perforate member and the imperforate backing member.

17. A rotor blade containment assembly as claimed in claim 1 wherein the rotor blades are fan blades and the casing is a fan casing.

18. A rotor blade containment assembly according to claim 1, wherein the downstream portion of the casing is disposed between the rotor blades and an adjacent plurality of guide vanes.

19. A rotor blade containment assembly for a gas turbine engine comprising:

a cylindrical, or frustoconical, casing arranged to surround an arrangement of rotor blades; and at least one hollow tubular member arranged radially within and secured to the casing, the at least one hollow tubular member containing a filler material, the at least one hollow tubular member extends in a helix within the casing, wherein the at least one hollow tubular member is perforate such that the at least one hollow tubular member defines an acoustic liner.

* * * * *